US006431998B1

(12) United States Patent
Nakamura et al.

(10) Patent No.: US 6,431,998 B1
(45) **Date of Patent: *Aug. 13, 2002**

(54) SOLID GOLF BALL

(75) Inventors: Atsushi Nakamura; Hisashi Yamagishi; Takashi Maruko; Yutaka Masutani, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/466,799

(22) Filed: Dec. 20, 1999

(30) Foreign Application Priority Data

Feb. 10, 1999 (JP) ..... 11-032603

(51) Int. Cl.[7] ..... A63B 37/04; A63B 37/06
(52) U.S. Cl. ..... 473/371; 473/377
(58) Field of Search ..... 473/351, 357, 473/361, 362, 363, 364, 370, 371, 373, 374, 376, 377

(56) References Cited

U.S. PATENT DOCUMENTS 5,772,531 A * 6/1998 Ohsumi et al. ..... 473/376
5,830,086 A * 11/1998 Hayashi et al. ..... 473/376
5,967,907 A * 10/1999 Takemura et al. ..... 473/373
6,045,460 A * 4/2000 Hayashi et al. ..... 473/376
6,048,279 A * 4/2000 Masutani et al. ..... 473/372
6,071,201 A * 6/2000 Maruko ..... 473/373
6,254,495 B1 * 7/2001 Nakamura et al. ..... 473/371
6,271,296 B1 * 8/2001 Nakamura et al. ..... 524/423
6,290,612 B1 * 9/2001 Maruko et al. ..... 473/376

FOREIGN PATENT DOCUMENTS

JP 02048526 * 2/1990 ..... A63B/37/00
JP 10-113406 5/1998
JP 10-314341 12/1998

* cited by examiner

*Primary Examiner*—Paul T. Sewell
*Assistant Examiner*—Alvin A. Hunter
(74) *Attorney, Agent, or Firm*—Sughrue Mion, PLLC

(57) ABSTRACT

In a solid golf ball comprising a solid core and a cover, the solid core has a multilayer construction which includes a center core and an outer core that encloses the center core. The center core is composed primarily of a resin and has a diameter of 3–20 mm and a specific gravity of 0.90–1.50. The center core has a surface Shore D hardness of 40–95 which is at least 10 units greater than the Shore D hardness of an innermost layer of the outer core. The ball has an excellent click and feel.

18 Claims, 1 Drawing Sheet

SOLID GOLF BALL

The present invention relates to a multi-piece solid golf ball having an improved "click" and "feel" when hit with a golf club.

BACKGROUND OF THE INVENTION

A variety of multi-piece golf balls, including three-piece and four-piece balls, have been developed over the past few years in order to improve ball performance.

Most of these golf balls have a center core of about 30 mm in diameter that is made of a rubber-based material to maintain the resilience of the golf ball. The rubber center core exerts a large influence on ball performance when the ball is hit. Balls designed for golfers with a high golf club head speed generally have a hard feel when hit, while balls designed for low head speed golfers have too soft a feel. Hence, there has remained substantial room for improvement. That is, balls containing a soft center core have a soft feel while balls containing a hard center core have a hard feel to the full spectrum of golfers, from players of ordinary skill to skilled amateurs and professional golfers.

The clicking sound made when a golf ball is hit, which is an important feature of the ball, is also strongly affected by the center core. Again, for the most part, balls containing a soft center core have a dull "click" when hit, whereas balls containing a hard center core have a high-pitched "click."

SUMMARY OF THE INVENTION

Therefore, an object of the present invention is to provide a solid golf ball having a good feel and an agreeable click.

It has been found that the feel of a golf ball can be varied and the click improved by dividing the solid core into a center core and an outer core and optimizing each of these two layers. More specifically, it has been found that reducing the size of the center core to a diameter of 3 to 20 mm, which is smaller than in conventional golf balls, provides an unprecedented click and feel, particularly when deformation of the ball is large, without adversely affecting the resilience and other key characteristics of the ball.

Moreover, although it is conventional practice to form the center core of a rubber-based material to maintain the ball's resilience, given the limited hardness achievable with rubber materials and the loss in productivity encountered when such materials are used to form small-diameter center cores, a center core composed primarily of a resin provides certain advantages. While the use of a resin sphere does give a center core having a lower resilience than one made of a conventional rubber material, the decline in the resilience of the ball as a whole is minimized by setting the diameter of the center core within the above-indicated range of 3 to 20 mm. The degree of this decline in the ball's resilience varies with the diameter of the center core, becoming larger as the diameter of the resin center core increases. The specific gravity G and the diameter d in millimeters of the center core are made to satisfy the relationship:

$$G \geqq 0.014d+0.929.$$

That is, a center core having a larger diameter has a higher specific gravity. In general, adding a filler to a certain material to increase its specific gravity has the effect of lowering its resilience. When the center core is formed so that the specific gravity rises with increasing diameter, it becomes possible in turn to lower the specific gravity of the outer core and thus compensate for the low resilience of the center core. As long as the center core is given a small diameter and the specific gravity of the center core is suitably adjusted in accordance with its size, the center core can be made of resin without compromising the performance of the ball as a whole.

It has also been found that when the Shore D hardness of the center core is set within a relatively hard range of 40 to 95 and the innermost layer of the outer core is formed so as to be at least 10 Shore D units softer than the center core, the resulting soft core containing a small, hard center has the overall effect of imparting a soft, yet solid feel and an appropriately high-pitched click to the ball when hit with a golf club.

Accordingly, the present invention provides a solid golf ball comprising a solid core and a cover that encloses the solid core, the solid core having a multiplayer construction which includes a center core. The center core is composed primarily of a resin and has a diameter d of 3 to 20mm and a specific G of 0.90 to 1.50 which satisfy the condition: $G \geqq 0.014[a]d+0.929$. The center core has a Shore D hardness at the surface thereon of 40 to 95, and the outer core has a Shore D hardness at the innermost layer portion thereof which is at least 10 units lower than the Shore D hardness at the surface of the center core.

The hardness of the overall ball can be optimized by setting the deflection of the solid core under a static load of 100 kg within a range of 2.2 to 4.3 mm. Preferably, the innermost layer of the outer core is composed primarily of resin or a mixture of resin and rubber.

By thus having the solid core of a golf ball contain a small, hard center core made of resin, there can be obtained a golf ball having an unprecedented feel and an agreeable click that is not too low in pitch.

BRIEF DESCRIPTION OF THE DRAWING

The sole figure.

DETAILED DESCRIPTION OF THE INVENTION

Figure 1:
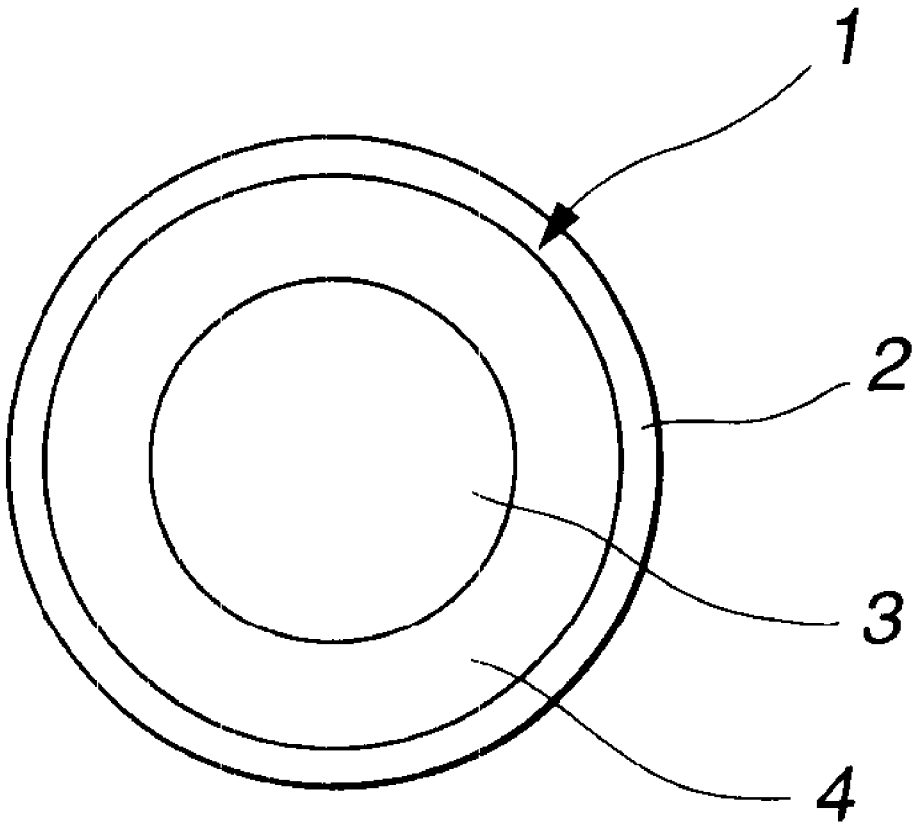
FIG. 1 is a sectional view showing a solid golf ball according to one embodiment of the invention.

Referring to FIG. 1, the solid golf ball of the invention has a solid core 1 enclosed within a cover 2. The solid core 1 has a center core 3 and an outer core 4 which covers the surface of the center core 3 and is itself enclosed by the cover 2. The solid core 1 shown in FIG. 1 is composed of two layers and the cover 2 is composed of a single layer. However, if necessary, the outer core 4 of the solid core 1 may itself be composed of two or more layers, and the cover 2 may be composed of two, three or more layers.

Unlike prior-art golf balls, the center core 3 in the solid core 1 of the inventive golf ball is not made of a rubber composition, but rather is composed primarily of a resin.

Examples of resins that may be used in the center core 3 include known thermoplastic resins and thermoplastic elastomers, such as nylons, polyarylates, ionomer resins, polypropylene resins, thermoplastic polyurethane elastomers and thermoplastic polyester elastomers. Commercially available resins that are highly suitable for this purpose include Surlyn AD8512 (an ionomer resin manufactured by E. I. DuPont de Nemours and Co.), Himilan 1706 and 1707 (ionomer resins manufactured by DuPont-Mitsui Polychemicals Co., Ltd.), Rilsan BMNO (a nylon resin manufactured by Toray Industries, Inc.) and U-Polymer U-8000 (a polyarylate resin manufactured by Unitika, Ltd.).

If desired, an inorganic filler such as barium sulfate, titanium dioxide or zinc oxide may be included as a weight modifier in the resin material. The weight of the center core 3 can be increased by incorporating a large amount of such a filler. This in turn allows the proportion of the rubber component in the outer core 4 (subsequently described) to be increased, enabling a remarkable improvement in the resilience of the golf ball. The use of a high specific gravity filler is advantageous in production as well in that it allows the degree of center core eccentricity to be easily determined nondestructively by x-ray inspection. The amount of weight modifier included is preferably 0 to about 115 parts by weight, and especially about 5 to about 100 parts by weight per 100 parts by weight of resin.

The center core made primarily of the above type of resin has a diameter of from 3 to 20 mm, preferably 5 to 18 mm, and especially 8 to 15 mm. Too small a center core fails to achieve the intended effects, whereas one that is too large may adversely affect the resilience of the ball.

The center core has a specific gravity of from 0.90 to 1.50, and especially 1.00 to 1.45. Moreover, it is formed such as to satisfy the relationship:

$$G \geqq 0.014d+0.929,$$

wherein G represents the specific gravity of the center core 3 and d represents the diameter (in millimeters) of the center core.

The center core at the surface thereof has a Shore D hardness within a range of 40 to 95, preferably 43 to 90, and especially 45 to 87. If the center core 3 has too low a hardness, i.e., is excessively soft, improvements in the click and feel cannot be achieved.

The center core can be produced by injection molding a center core material composed primarily of the above-described resin.

Next, the outer core 4 which encloses the center core 3 may be composed of a single layer or have a multilayer construction composed of two or more layers. The innermost layer of the outer core which contiguously encloses the center core must have a Shore D hardness which is lower than the Shore D hardness of the center core. Specifically, the innermost layer of the outer core must have a Shore D hardness that is at least 10 units, preferably at least 12 units, and most preferably at least 15 units lower than the Shore D hardness of the center core. A hardness difference of less than 10 will not allow sufficient improvement to be achieved in the click and feel of the ball. If the innermost layer of the outer core is made of a rubber material or the like and has a hardness distribution, all areas of the innermost layer, and thus the hardest area thereof, must have a Shore D hardness which is at least 10 units lower than the Shore D hardness of the center core.

So long as the outer core 4 has the above-described hardness difference with the center core 3, the outer core 4 is not subject to any other limitation. The material used to make the outer core 4 may be a rubber base conventionally used for the same purpose, a thermoplastic resin base material, or a mixture of rubber with a thermoplastic resin.

The larger the diameter of the center core 3 and the greater its hardness, the more desirable it becomes for achieving good adhesion between the center core 3 and the outer core 4 to enclose the center core 3 with a thermoplastic resin or a mixture of a thermoplastic resin and rubber.

When the center core 3 is enclosed in this way within a resin or a resin-rubber mixture, the outer core 4 preferably has a two-layer construction in which the resin or resin-rubber mixture is enclosed as the inside layer within an outside layer formed of a rubber composition. However, the ball may be composed entirely of resin materials so long as the materials used are capable of ensuring the resilience of the ball.

The thermoplastic resin making up the outer core 4 may be the same as that used in the center core 3. Suitable examples include ionomer resins, thermoplastic polyurethane elastomers and thermoplastic polyester elastomers.

If a mixture of the resin with rubber is to be used, this mixture may be formulated by dispersing a diene rubber such as butadiene rubber in an ionomer resin and effecting crosslinkage as described in JP-A 10-113406. Alternatively, the mixture may be a blend of an ionomer resin with a functional rubbery copolymer such as a crosslinked rubber having carboxyl groups incorporated therein, as described in JP-A 10-314341.

The rubber composition for use in the outer core is preferably one comprising polybutadiene as the base. The use of cis-1,4-polybutadiene having a cis structure of at least 40% is especially suitable. Where desired, other suitable rubber ingredients such as natural rubber, polyisoprene rubber or styrene-butadiene rubber may be compounded with the polybutadiene to give the base rubber. The resilience of the golf ball can be improved by increasing the proportion of the polybutadiene component. Up to about 10 parts by weight of the other rubber ingredients may be compounded per 100 parts by weight of the polybutadiene.

A crosslinking agent may be included in the rubber composition. Exemplary crosslinking agents are the zinc and magnesium salts of unsaturated fatty acids, such as zinc dimethacrylate and zinc diacrylate, and ester compounds such as trimethylpropane methacrylate. Zinc diacrylate is especially preferred for achieving a high resilience. The crosslinking agent is preferably included in an amount of about 10 to 30 parts by weight per 100 parts by weight of the base rubber.

In the practice of the invention, a vulcanizing agent is generally compounded in the rubber composition. It is recommended that the vulcanizing agent include a peroxide having a one minute half-life temperature of lower than 155° C. in an amount of at least 30% by weight, and especially 40 to 70% by weight based on the overall vulcanizing agent. Examples of suitable peroxides include commercially available products such as Perhexa 3M (manufactured by Nippon Oils and Fats Co., Ltd.). The amount of vulcanizing agent included in the rubber composition is preferably from about 0.6 to 2 parts by weight per 100 parts by weight of the base rubber.

If necessary, other suitable ingredients may also be blended in the rubber composition, such as an antioxidants and specific gravity-modifying fillers (e.g., zinc oxide, barium sulfate). The amount of such specific gravity modifiers blended is typically from about 1 to 30 parts by weight per 100 parts by weight of the base rubber.

The solid core 1 composed of a center core 3 enclosed within an outer core 4 as described above preferably has a diameter of 36 to 41.5 mm. If the outer core is formed of a resin or a resin-rubber mixture on the inside and of a rubber composition on the outside, the inside layer preferably has a thickness of 0.5 to 5.0 mm, and especially 1.0 to 4.0 mm, while the outside layer preferably has a thickness of 4 to 17 mm, and especially 6 to 15 mm.

The specific gravity of the outer core is not critical. The (outer core) layer composed primarily of resin will have a specific gravity of 0.90 to 1.30, and preferably 0.95 to 1.25, while the (outer core) layer composed primarily of rubber will have a specific gravity of 1.00 to 1.30, and preferably 1.05 to 1.25.

Preferably the solid core has a deflection of 2.2 to 4.3 mm, more preferably 2.4 to 4.1 mm, and most preferably 2.5 to 4.0 mm under an applied load of 100 kg. A deflection of less than 2.2 mm may give the golf ball too hard a feel when hit, whereas a deflection of more than 4.3 mm may result in a feel that is so soft as to detract from the performance of the ball.

Production of the solid core may be carried out using a known method to vulcanize and cure the rubber composition. For example, one highly suitable method is a two-step process in which the rubber composition is first subjected to primary vulcanization (semi-vulcanization) in a mold to form a pair of hemispherical cups. A preformed center core is then placed in one of the hemispherical cups, the other cup is closed over the center core, and secondary vulcanization (complete vulcanization) is carried out. That is, formation of the outer core also completes production of the solid core. Since the above method requires vulcanization to form the outer core, the center core is exposed to an elevated temperature. Hence, it is advantageous for the center core to have a melting point of at least 150° C. When a resin or a resin-rubber mixture is used in the outer core, it may be injection molded.

An adhesive is typically applied to the center core before it is placed in the hemispherical cup. The adhesive provides a secure bond at the interface between the center core and the outer core, thereby enhancing the durability of the golf ball and helping to achieve a high resilience. To increase adhesion between the center core and the outer core, it is also advisable to roughen the surface of the center core in an apparatus such as a tumbler to form minute irregularities thereon before placing it in the outer core.

The golf ball of the invention is made by forming a cover 2 around the solid core 1. The cover may be made of a known cover stock material. Preferably the cover has a thickness of 0.5 to 3.5 mm, and especially 1 to 2.5 mm, and a Shore D hardness of 40 to 75, more preferably 45 to 70, and most preferably 50 to 65. A hardness that is too low may result in a poor ball resilience, whereas excessive hardness may compromise the durability of the ball. It is recommended that the cover have a specific gravity of 0.95 to 1.25. As already noted, the cover 2 may be composed of one layer or a plurality of layers.

A known cover stock material may be used to form the cover. Examples include ionomer resins, balata rubber, and thermoplastic polyurethane, polyamide and polyester elastomers. The cover is preferably formed by a conventional injection molding process.

It is recommended that the solid golf ball thus formed have a deflection of 2.2 to 3.8 mm, and especially 2.4 to 3.5 mm under a static load of 100 kg.

As in conventional golf balls, the golf ball of the invention has numerous dimples formed on the surface of the cover. The total number of dimples is preferably from 350 to 500, more preferably from 370 to 480, and most preferably from 390 to 450. The dimples may be distributed in a geometrical arrangement that is octahedral or icosahedral, for example. Nor is the dimple pattern limited to a circular pattern, the use of any other suitable pattern, such as a square, hexagonal, pentagonal or triangular pattern, also being acceptable.

It is recommended to optimize the diameter, depth, and cross-sectional shape of dimples for improving the distance of the ball. Dimples may be provided so that the dimple surface coverage, which is defined as the ratio: (surface area of ball occupied by dimples)/(total surface area of ball) and expressed as a percentage, is preferably at least 65%, and more preferably 70% to 80%. A dimple surface coverage of less than 65% will sometimes fail to achieve an increased carry. The dimple volume ratio, which is defined as (total volume of dimples)/(volume of ball) and expressed as a percentage, may be set within a range of preferably 0.76% to 1.0%, and especially 0.78% to 0.94%. A dimple volume ratio less than 0.76% may result in too high a trajectory and a dimple volume ratio greater than 1.0% may result in too low a trajectory, the effect of either being a decrease in the carry of the ball.

The golf ball of the invention should be formed to have a diameter and weight which conform with the Rules of Golf. That is, the ball should have a diameter of not less than 42.67 mm and a weight of not greater than 45.93 g.

The solid golf ball of the invention, as described herein, provides an excellent click and feel when hit with a golf club.

EXAMPLE

Examples of the invention and comparative examples are given below by way of illustration, and are not intended to limit the invention.

Examples and Comparative Examples

In each example, a center core having the characteristics indicated in Table 1 was produced by injection molding a resin compound having the composition shown in the table in a mold. In some of the examples, a resin blend having the composition shown in the table was injection molded over the center core. In addition, a rubber composition was intimately mixed in a roll mill, then subjected to 6 minutes of primary vulcanization (semi-vulcanization) at 130° C. to form a pair of hemispherical cups. The pair of cups was either closed over the resin blend that had been injection molded about the center core or was closed directly over the center core, following which the outer core was subjected to 15 minutes of secondary vulcanization (complete vulcanization) at 155° C. to give a solid core having a two- or three-layer construction.

The cover stock material shown in Table 1 was then injection molded over the solid core in each example to form a cover having a thickness of 2.1 mm and bearing 392 dimples (dimple surface coverage, 78%; dimple volume ratio, 0.88%) to give a solid golf ball having the characteristics shown in the table.

The properties of the resulting golf balls were measured and evaluated as described below. The results are presented in Table 1.

Flight Performance

The golf balls obtained in each example were measured for carry and total distance when hit with a driver (No. 1 wood) at a head speed of 40 m/s (HS40) using a swing robot.

Click and Feel

The click and feel of the golf balls in each example when hit with a No. 1 wood were rated as follows by three professional golfers.

Feel

Good: All three golfers thought ball had an appropriately soft, yet solid feel.

Poor: All three golfers thought ball had too soft a feel.

Click

Good: All three golfers thought click was appropriate.

Fair: Two of the golfers thought click sounded dull.

Poor: All three golfers thought click sounded dull.

TABLE 1

| Composition (parts by weight) | | EX 1 | EX 2 | EX 3 | EX 4 | CE 1 | CE 2 | CE 3 |
|---|---|---|---|---|---|---|---|---|
| Center core | Surlyn AD-8512 (ionomer) | — | — | — | 100 | — | 100 | — |
| | Rilsan BMNO (polyamide) | 100 | 100 | 100 | — | 100 | — | — |
| | Hytrel 3548 | — | — | — | — | — | — | 100 |
| | Barium sulfate | 10.0 | — | — | 15.0 | 20.0 | — | — |
| Outer core 1 | Himilan 1557 | 50 | 50 | — | — | — | 50 | — |
| | Surlyn 8120 | 50 | 50 | — | — | — | 50 | — |
| | XER91P* | — | 10 | — | — | — | 10 | — |
| | cis-1,4-Polybutadiene | — | — | 100 | 100 | 100 | — | 100 |
| | Zinc oxide | — | — | 5 | 5 | 5 | — | 5 |
| | Barium sulfate | — | — | 17.5 | 20.5 | 9.0 | — | 20.5 |
| | Zinc diacrylate | — | — | 29.0 | 22.0 | 29.0 | — | 22.0 |
| | Dicumyl peroxide | — | — | 1.2 | 1.2 | 1.2 | — | 1.2 |
| Outer core 2 | cis-1,4-Polybutadiene | 100 | 100 | — | — | — | 100 | — |
| | Zinc oxide | 5 | 5 | — | — | — | 5 | — |
| | Barium sulfate | 21.0 | 19.5 | — | — | — | 30.5 | — |
| | Zinc diacrylate | 29.0 | 28.5 | — | — | — | 28.5 | — |
| | Dicumyl peroxide | 1.2 | 1.2 | — | — | — | 1.2 | — |
| Cover formulation | Himilan 1605 | — | — | — | 50 | 50 | 50 | 50 |
| | Himilan 1706 | — | — | — | 50 | 50 | 50 | 50 |
| | Himilan 1557 | 50 | 50 | 50 | — | — | — | — |
| | Himilan 1601 | 50 | 50 | 50 | — | — | — | — |
| Center core | Diameter (mm) | 18.0 | 10.0 | 13.0 | 5.0 | 25.0 | 18.0 | 10.0 |
| | Weight (g) | 3.7 | 0.6 | 1.3 | 0.1 | 10.6 | 3.0 | 0.6 |
| | Specific gravity | 1.22 | 1.14 | 1.14 | 1.08 | 1.30 | 0.98 | 1.15 |
| | Surface Shore D hardness | 80 | 80 | 80 | 64 | 81 | 64 | 35 |
| Outer core 1 | Diameter (mm) | 23.0 | 15.0 | 38.5 | 38.5 | 38.5 | 23.0 | 38.5 |
| | Weight (g) | 7.0 | 1.8 | 35.0 | 35.0 | 35.0 | 6.3 | 35.0 |
| | Specific gravity of material | 0.98 | 0.98 | 1.17 | 1.17 | 1.12 | 0.98 | 1.17 |
| | Shore D hardness | 50 | 49 | 45–53 | 40–44 | 45–53 | 49 | 40–44 |
| | Primary vulcanization conditions | — | — | 130° C., 6 min | 130° C., 6 min | 130° C., 6 min | — | 130° C., 6 min |
| | Secondary vulcanization conditions | — | — | 155° C., 15 min | 155° C., 15 min | 155° C., 15 min | — | 155° C., 15 min |
| Outer core 2 | Diameter (mm) | 38.5 | 38.5 | — | — | — | 38.5 | — |
| | Weight (g) | 35.0 | 35.0 | — | — | — | 35.0 | — |
| | Specific gravity of material | 1.19 | 1.18 | — | — | — | 1.22 | — |
| | Primary vulcanization conditions | 130° C., 6 min | 130° C., 6 min | — | — | — | 130° C., 6 min | — |
| | Secondary vulcanization conditions | 155° C., 15 min | 155° C., 15 min | — | — | — | 155° C., 15 min | — |
| Deflection of solid core under 100 kg load (mm) | | 2.5 | 2.9 | 2.7 | 3.5 | 2.1 | 2.5 | 3.2 |
| Golf ball | Weight (g) | 45.3 | 45.3 | 45.3 | 45.3 | 45.3 | 45.3 | 45.3 |
| | Diameter (mm) | 42.7 | 42.7 | 42.7 | 42.7 | 42.7 | 42.7 | 42.7 |
| | Shore D hardness of cover | 58 | 58 | 58 | 64 | 64 | 64 | 64 |
| | Cover thickness (mm) | 2.1 | 2.1 | 2.1 | 2.1 | 2.1 | 2.1 | 2.1 |
| Performance at HS40 | Carry (m) | 195.0 | 193.5 | 193.0 | 192.0 | 187.0 | 187.5 | 193.0 |
| | Total distance (m) | 211.0 | 209.0 | 208.5 | 210.0 | 201.0 | 202.0 | 209.0 |
| | Feel | good | good | good | good | good | good | poor |
| | Click | good | good | good | good | fair | good | poor |

XER91P is a resin modifier supplied by Japan Synthetic Rubber Co., Ltd. which is composed of a functional rubbery copolymer obtained by conferring a crosslinked acrylonitrile-butadiene rubber with carboxyl functionality.

Japanese Patent Application No. 11-032603 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid golf ball comprising: a solid core and a cover that encloses the solid core, the solid core having a multi-layer construction which includes a center core and an outer core that encloses the center core, wherein the center core is composed primarily of a resin and has a diameter d and a specific gravity G which satisfy the relationships (i)-(ii):

(i) $3 \leqq d(\text{mm}) \leqq 13$, and (ii) $(0.014d+0.929) \leqq G \leqq 1.5$, the center core has a Shore D hardness of 40 to 95 at the surface thereon, and the outer core has a Shore D hardness at an innermost layer thereof which is formed of a rubber base material, a thermoplastic resin base material, or a mixture of rubber with a thermoplastic resin which is at least 10 unitslower than the Shore D hardness at the surface of the center core.

2. The solid golf ball of claim 1, wherein the solid core has a deflection of 2.2 to 4.3 mm under an applied load of 100 kg.

3. The golf ball of claim 1, wherein said outer core comprises at least two layers.

4. The solid golf ball of claim 1, wherein said cover comprises at least two layers.

5. The solid golf ball of claim 1, wherein said resin forming said center core is selected from the group consisting of nylon, polyarylate, ionomer resin, polyproplene resin, thermoplastic polyurethane elastomer and thermoplastic polyester elastomer.

6. The solid golf ball of claim 1, wherein an inorganic filler is added to said resin of the center core.

7. The solid golf ball of claim 1, wherein the diameter of said center core is at least 8 mm.

8. The solid golf ball of claim 1, wherein the specific gravity of the center core is in the range of 1.00 to 1.45.

9. The solid golf ball of claim 1, wherein the surface hardness of said center core is in the range of 45 to 87 on Shore D.

10. The solid golf ball of claim 1, wherein the difference in hardness between the innermost layer of the outer core and the surface of the center core is at least 15 Shore D units.

11. The solid golf ball of claim 1, wherein said outer core comprise a thermoplastic resin.

12. The solid golf ball of claim 1, wherein said solid core has a diameter in the range of 36 to 41.5 mm.

13. The solid golf ball of claim 1, wherein said cover has a thickness in the range of 0.5 mm and a Shore D hardness in the range of 40 to 75.

14. The solid golf ball of claim 1, wherein the golf ball as a whole has a deflection in the range of 2.2 to 3.8 mm under a static load of 100 kg.

15. A solid golf ball comprising: a solid core and a cover that encloses the solid core, the solid core having a multi-player construction which includes a center core and outer core that encloses the center core, wherein the center core is composed primarily of a resin and has a diameter d and a specific gravity G which satisfy the relationships (i)-(ii):

$$\text{(i)}\ 3 \leqq d(\text{mm}) \leqq 13,$$

and $$\text{(ii)}\ [G \geqq](0.014d+0.929) \leqq G \leqq 1.5,$$

the center core has a Shore D hardness of 40 to 95 at the surface thereon, the outer core has a Shore D hardness at the inner most layer thereof which is composed primarily of a resin or a resin and rubber mixture which is at least 10 units lower than the Shore D hardness at the surface of the center core, and the solid core has a deflection of 2.2 to 4.3 mm under an applied load of 100kg.

16. A solid golf ball comprising: a solid core and cover that encloses the solid core; the solid core having a multi-player construction which includes a center core and an outer core that encloses the center core, wherein the center core is composed primarily of a resin which is added with an inorganic filler and has a diameter d and a specific gravity G which satisfy the relationship (i)–(ii):

$$\text{(i)}\ 3 \leqq d(\text{mm}) \leqq 13,$$

and $$\text{(ii)}\ [G \geqq](0.014+0.929) \leqq G \leqq 1.5$$

the center core has a Shore D hardness of 40 to 95 at the surface thereon, and the outer core has a Shore D hardness at an innermost layer thereof which is composed primarily of a resin or a resin and rubber mixture which is at least 10 units lower than the Shore D hardness at the surface of the center core.

17. A solid golf ball comprising: a solid core and a cover that encloses the solid core, the solid core having a multi-layer construction which includes a center core and an outer core that encloses the center core, wherein the center core is composed primarily of a resin and has a diameter d and a specific gravity G which satisfy the relationships (i)-(ii):

$$\text{(i)}\ 3 \leqq d(\text{mm}) \leqq 13,$$

and $$\text{(ii)}\ (0.014d+0.929) \leqq G \leqq 1.5$$

the center core has a Shore D hardness of 40 to 95 at the surface thereon, the outer core has a Shore D hardness at an innermost layer thereof which is composed primarily of a resin or a resin and rubber mixture which is at least 10 units lower than the Shore D hardness at the surface of the center core, and the golf ball an a whole has a defection in the range of 2.2 to 3.8 mm under an static load of 100 kg.

18. A solid golf ball comprising: a solid core and a cover that encloses the solid core, the solid core having a multi-player construction which includes a center core and an outer core that encloses the center core, wherein the center core is composed primarily of a resin and has a diameter d and a specific gravity G which satisfy the relationships (i)-(ii):

$$\text{(i)}\ 3 \leqq d(\text{mm}) \leqq 13,$$

and $$\text{(ii)}\ (0.014d+0.929) \leqq G \leqq 1.5$$

the center core has a Shore D hardness of 40 to 95 at the surface thereon, and the outer core has a Shore D hardness at an innermost layer thereof which is formed if a rubber base material which is at least 10 units lower than the Shore D hardness at the surface of the center core.

* * * * *